US007866757B2

(12) United States Patent
Boucherie

(10) Patent No.: US 7,866,757 B2
(45) Date of Patent: Jan. 11, 2011

(54) BRUSH STUFFING MACHINE

(75) Inventor: Bart Gerard Boucherie, Izegem (BE)

(73) Assignee: Firma G.B. Boucherie N.V., Izegem (BE)

( * ) Notice: Subject to any disclaimer, the term of this patent is extended or adjusted under 35 U.S.C. 154(b) by 993 days.

(21) Appl. No.: 11/645,486

(22) Filed: Dec. 26, 2006

(65) Prior Publication Data

US 2007/0145812 A1 Jun. 28, 2007

(30) Foreign Application Priority Data

Dec. 27, 2005 (DE) ..... 20 2005 020 231 U

(51) Int. Cl.
*A46D 3/04* (2006.01)

(52) U.S. Cl. ..... 300/5; 300/7; 300/8

(58) Field of Classification Search ..... 300/5, 300/7, 8, 21
See application file for complete search history.

(56) References Cited

U.S. PATENT DOCUMENTS

| | | | | |
|---|---|---|---|---|
| 3,059,972 | A * | 10/1962 | Herbert | 300/5 |
| 5,518,301 | A * | 5/1996 | Boucherie | 300/21 |
| 6,016,757 | A * | 1/2000 | Boucherie | 112/80.01 |
| 6,905,176 | B2 * | 6/2005 | Boucherie | 300/21 |
| 7,594,704 | B2 * | 9/2009 | Boucherie | 300/5 |

FOREIGN PATENT DOCUMENTS

| | | | |
|---|---|---|---|
| DE | 10160220 | | 6/2003 |
| EP | 0304110 | * | 8/1989 |
| EP | 1 493 355 | | 1/2005 |
| EP | 1 535 534 | | 6/2005 |

* cited by examiner

*Primary Examiner*—Laura C Guidotti
(74) *Attorney, Agent, or Firm*—Stuart J. Friedman

(57) ABSTRACT

A brush stuffing machine comprising a bristle magazine and a stuffing tool which is movable between a bundle take-over position and a stuffing position, the stuffing tool is pivotally mounted about an axis for movement on a circular arc between the take-over position and the stuffing position.

11 Claims, 4 Drawing Sheets

BRUSH STUFFING MACHINE

BACKGROUND OF THE INVENTION

1. Field of the Invention

This invention relates to a brush stuffing machine comprising a bristle magazine and a stuffing tool which is movable between a bundle take-over position and a stuffing position.

2. Description of Related Art

In the prior art, the stuffing tool is translationally movable between the bundle take-over position and the stuffing position. In the bundle take-over position, a bundle of bristles is transferred to the stuffing tool, which upon arrival of the stuffing tool at the stuffing position is inserted into a brush body disposed in a brush body holder.

A disadvantage of known stuffing tools is the fact that a comparatively complex guideway requiring much space is necessary for the stuffing tool, which in addition must be arranged in a region where little space is available. Furthermore, it is disadvantageous that at high clock rates the guideway for the stuffing tool comes up against the limits of its mechanical capacity.

BRIEF SUMMARY OF THE INVENTION

Thus, it is the object of the invention to create a brush stuffing machine which offers more possibilities with regard to the space conditions in the vicinity of the brush magazine and in front of the brush body holder and with regard to the admissible clock rates.

For the solution of this object, it is provided in accordance with the invention that the stuffing tool is pivotally mounted about an axis, so that it moves on a circular arc between the take-over position and the stuffing position. The invention is based on the knowledge that it is not necessary to insert the bundles of bristles into the brush bodies by means of an exactly linear movement. When the swivel radius of the stuffing tool is large enough, the deviations of the actual (curved) path of movement of the stuffing tool during insertion of the bundle of bristles into the brush body from the ideal (linear) path of movement are so small that they can be ignored. On the other hand, a few practical advantages are obtained: When using a rotary movement for the stuffing tool instead of a translational movement, the main bearing of the stuffing tool can be arranged far away from the region in front of the brush body holder. Thus, the stuffing tool is swivelled "from the outside" towards the brush body holder, without a complex bearing being necessary directly in front of the brush body holder and the bristle magazine. With regard to the mechanical loads, a swivel bearing is very much more advantageous than a translationally movable sliding bearing, as the relative velocity between stationary and moving parts is very much smaller in the case of a swivel bearing than in the case of a sliding bearing. In the case of a sliding guideway, the relative velocity between the stationary and the moving parts is equal to the maximum speed of movement of the stuffing tool, whereas in the case of a swivel bearing, the relative velocity is geared down in proportion to the radii of the stuffing tool and of the bearing surface.

In a manner known per se, the stuffing tool has a so-called tool tip at its front, by means of which the bristles are double-folded, before they are inserted into the brush body, and further to the rear so-called anchor cutting and anchor guiding plates, which together with the wire cutter form the wire anchors, which together with the bundles of bristles are inserted into the brush body.

Preferably, it is provided that a tongue is associated to the stuffing tool, which is pivotally driven about the same axis. The tongue pushes the bundles of bristles and the wire anchors through the tool tip into the brush body. The mounting of the tongue is effected in the same way as in the case of the stuffing tool at a distance from the brush body holder and from the bristle magazine.

Advantageous aspects of the invention can be taken from the sub-claims.

BRIEF DESCRIPTION OF THE DRAWINGS

The invention will subsequently be described with reference to an embodiment which is illustrated in the accompanying drawings, in which.

DETAILED DESCRIPTION OF THE INVENTION

Figure 1:
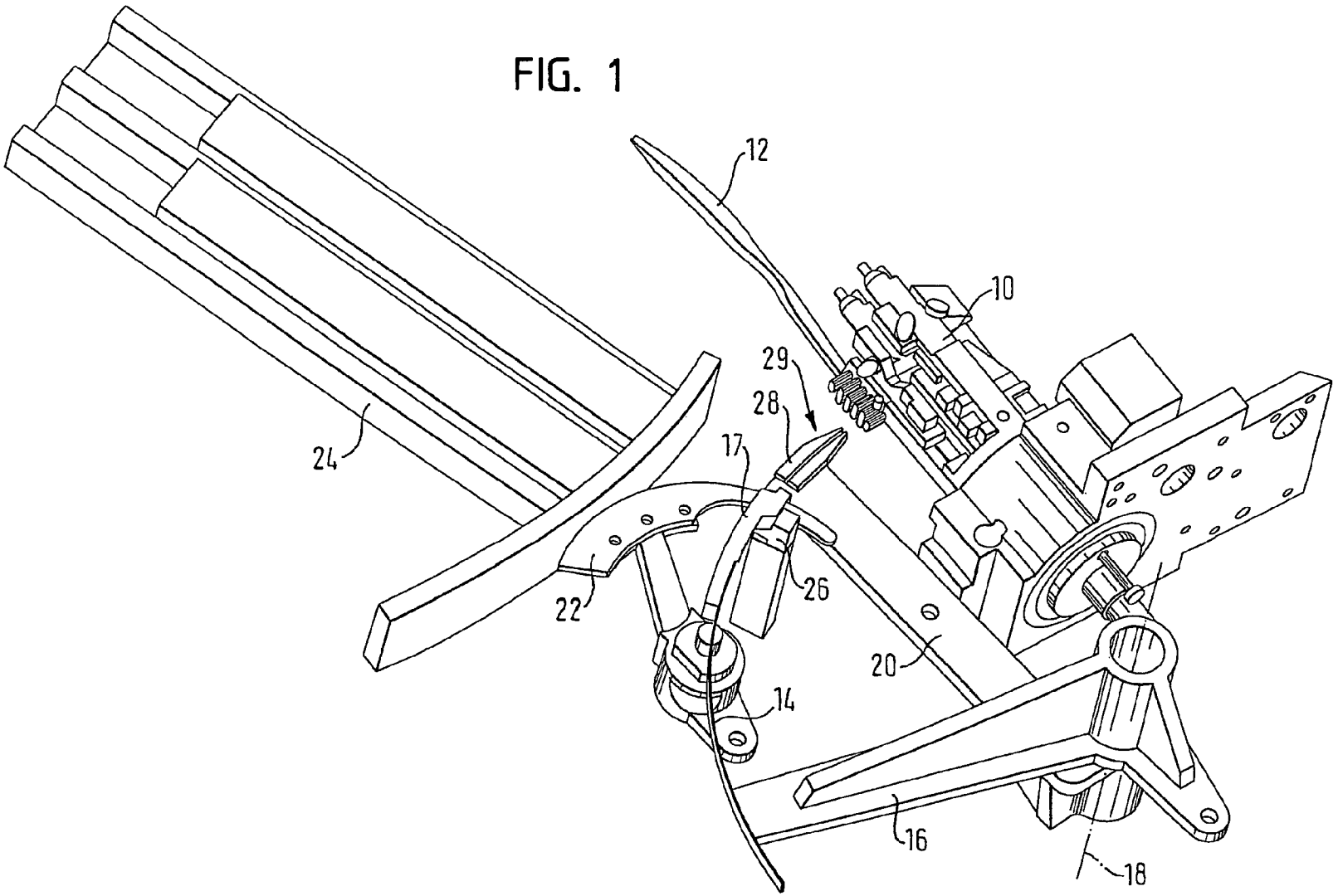
FIG. 1 is a perspective view of a brush stuffing machine.

FIG. 1 shows a brush stuffing machine to which a brush body holder 10 is associated, in which there is held a toothbrush 12 to be provided with bristles. The brush stuffing machine of the invention can of course also be used for fitting other brushes with bristles.

The brush stuffing machine includes a stuffing tool 29, which at its front end has a tool tip 28 with two tool jaws and at its rear end anchor cutting and anchor guiding plates 17. The stuffing tool 29 is curved in the shape of a circular arc and mounted on a swivel arm 20. The swivel arm 20 is pivotally mounted about a bearing axis 18 which here is indicated only schematically. For mounting the swivel arm 20, low-friction ball bearings are used. Inside the stuffing tool 29, an arcuately curved guiding groove is provided for a tongue 14, which can be swivelled relative to the stuffing tool 29. The tongue is guided by the guiding groove during all of its movement.

The tongue 14 is mounted on a swivel arm 16 which is pivotally mounted about the same bearing axis 18 as the swivel arm 20. As a result, the tongue 14 can perform a movement on a circular arc in the same way as the stuffing tool 29, the center of this circular arc lying on the bearing axis 18.

There is provided a bundle pick-up 22, which is pivotally mounted about an axis which is parallel to axis 18 of stuffing tool 29 and in a manner known per se can take a bundle of bristles from a bristle magazine 24.

Furthermore, a wire cutter 26 is provided, which can cut a piece of a certain length from a continuously supplied wire, which together with the bundle of bristles can be inserted into the brush 12 as a wire anchor.

Figure 2:
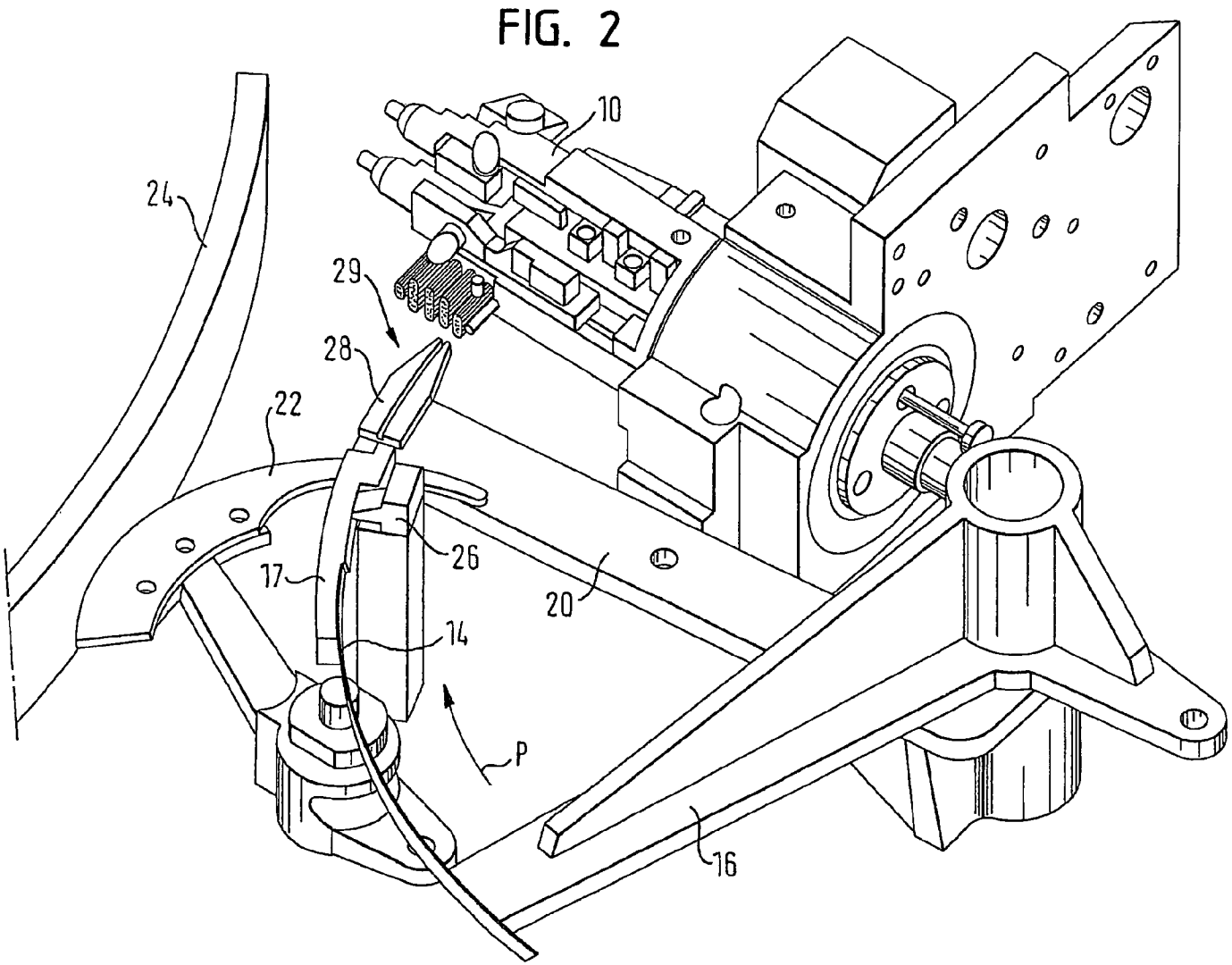
FIG. 2 shows part of the brush stuffing machine of FIG. 1 on an enlarged scale, wherein the stuffing tool is in a starting position.
Figure 3:
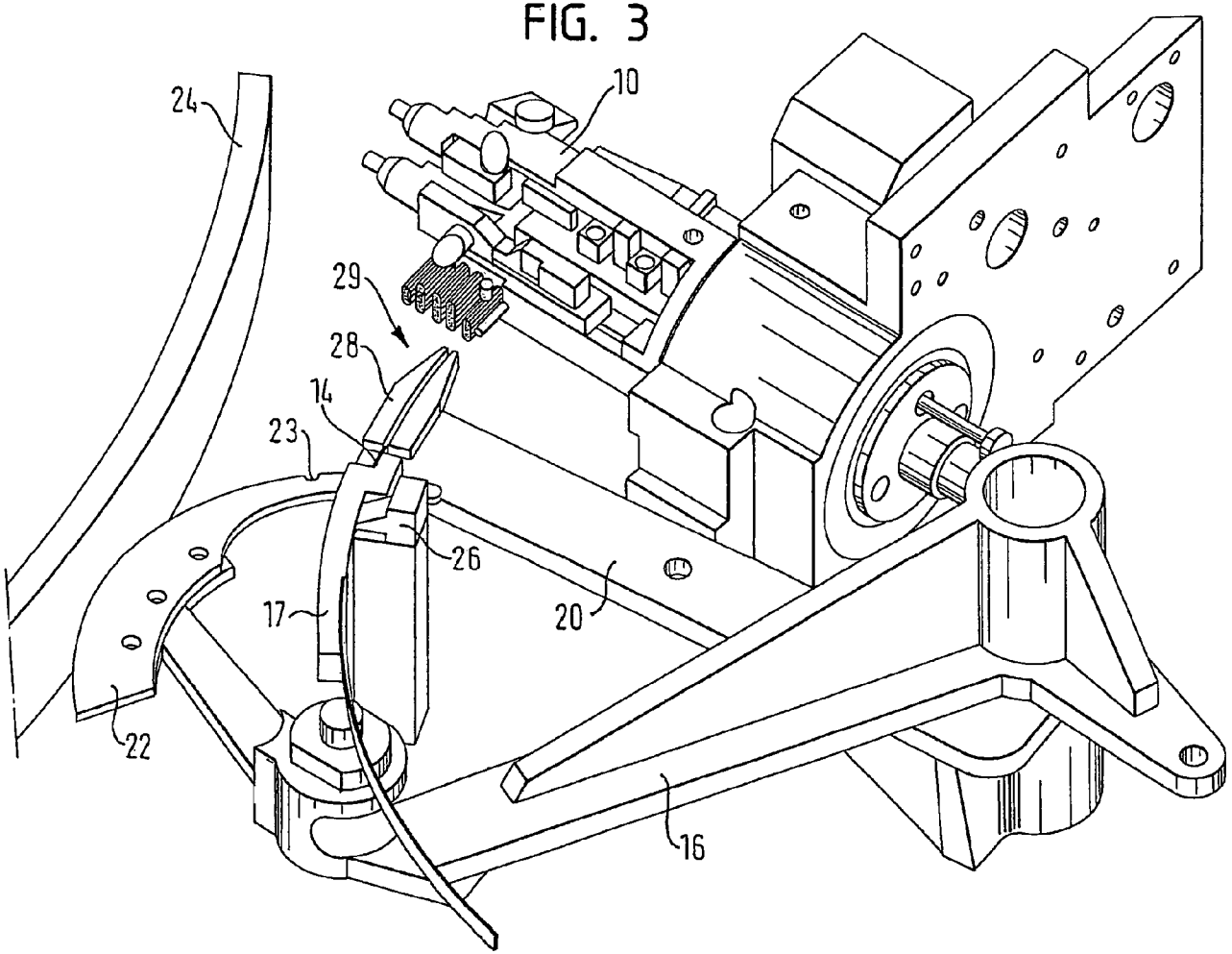
FIG. 3 is a view corresponding to the one of FIG. 2, wherein the stuffing tool is disposed between a bundle take-over position and a stuffing position.

The brush stuffing machine described above operates as follows: Starting in the starting position as shown in FIGS. 1 and 2, the stuffing tool 29 is swivelled in the direction of arrow P on a circular arc towards the brush body holder 10. The tongue which moves inside the stuffing tool 29 takes a wire anchor from the wire cutter 26 and a bundle of bristles from the bundle pick-up 22. Loaded with the bundle of bristles and the wire anchor, the tip of the stuffing tool 29 gets quite close to the brush body (see FIG. 3, where the bundle of bristles and the wire anchor have been omitted for the sake of clarity).

Figure 4:
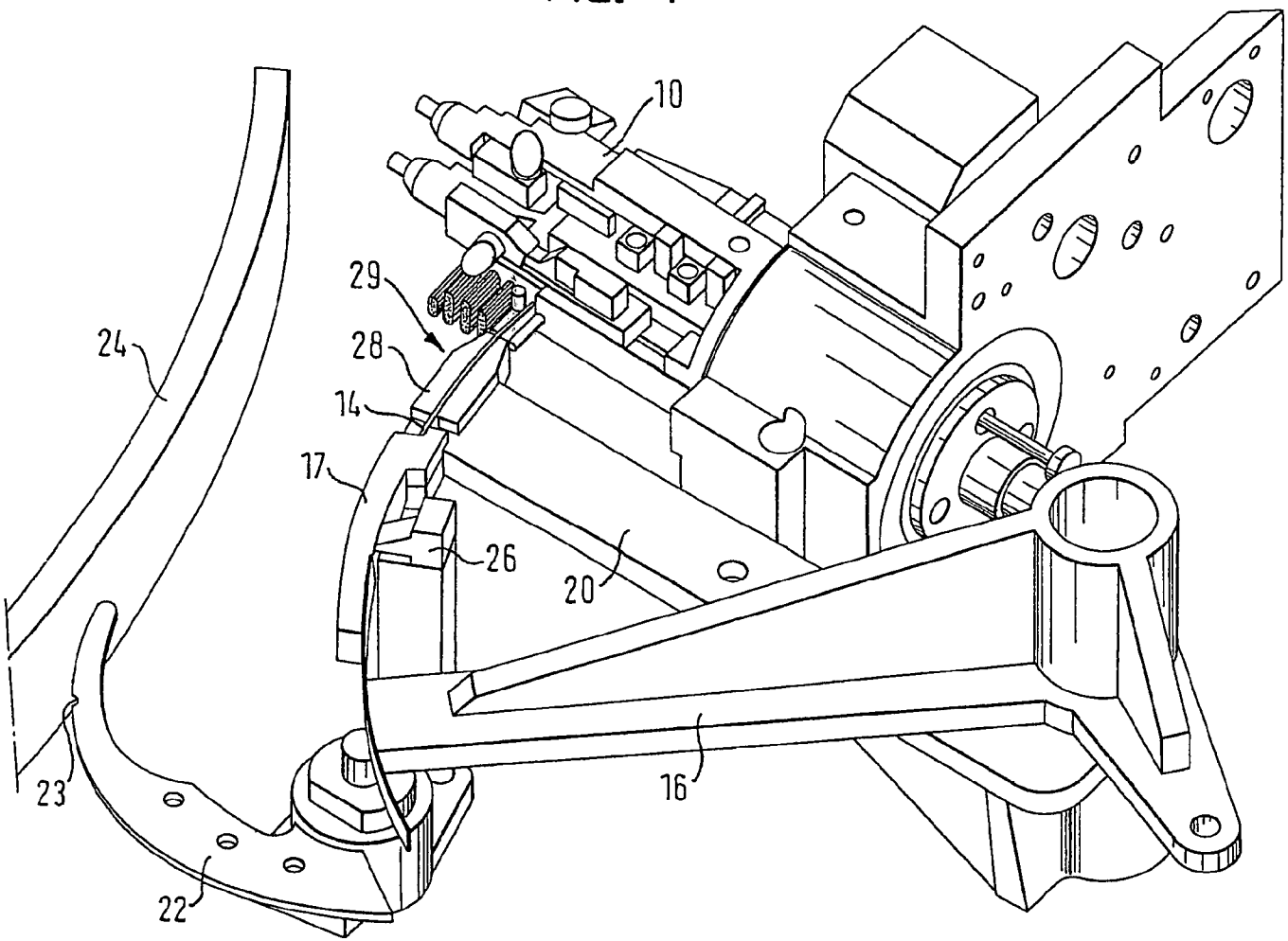
FIG. 4 is a view corresponding to the one of FIG. 2, wherein the stuffing tool is in the stuffing position.

Approximately at this time, the front end of the tongue 14 passes through the tool tip 28 and thereby inserts the bundle of bristles together with the wire anchor into the brush body held in the brush body holder 10 (see FIG. 4). For driving and synchronizing the two swivel movements of the stuffing tool 29 and the tongue 14, a cam and/or eccentric mechanism is used, for instance.

Synchronized with the movement of the stuffing tool 29 and the tongue 14, the bundle pick-up is swivelled such that its bundle pick-up notch 23 is swivelled towards the bristle magazine 24, as soon as the stuffing tool 29 has taken the corresponding bundle of bristles from the bundle pick-up notch 23. While the stuffing tool 29 is swivelled from the stuffing position shown in FIG. 4 back into the starting position shown in FIG. 2, the bundle pick-up 22 likewise returns to the position shown in FIG. 2, in which a new bundle of bristles is presented to the stuffing tool 29.

The invention claimed is:

1. A brush stuffing machine comprising a bristle magazine and a stuffing tool which is movable between a bundle take-over position and a stuffing position, said stuffing tool being pivotally mounted about an axis for movement on a circular arc between the take-over position and the stuffing position, and a bundle pick-up for cooperating with a bristle magazine in order to transfer a bundle of bristles to the stuffing tool in the bundle take-over position, the bundle pick-up being pivotally mounted about an axis which is parallel to the axis of the stuffing tool.

2. A brush stuffing machine comprising a bristle magazine and a stuffing tool which is movable between a bundle take-over position and a stuffing position, the stuffing tool being pivotally mounted on a swivel arm for swiveling movement about a pivot axis from the take-over position towards a brush holder.

3. The brush stuffing machine as claimed in claim 2, further including a tongue associated to the stuffing tool, said tongue being movable on a circular arc whose center lies on the same axis as the pivot axis of the stuffing tool.

4. The brush stuffing machine as claimed in claim 3, wherein the movements of the stuffing tool and the tongue are synchronized with each other when the same are swivelled from the bundle take-over position into the stuffing position.

5. The brush stuffing machine as claimed in claim 2, further including a bundle pick-up for cooperating with a bristle magazine in order to transfer a bundle of bristles to the stuffing tool in the bundle take-over position, the bundle pick-up being pivotally mounted about an axis which is parallel to the axis of the stuffing tool.

6. The brush stuffing machine as claimed in claim 2, further including a wire cutter for cooperating with the stuffing tool in order to transfer a wire anchor to the stuffing tool.

7. A brush stuffing machine comprising a bristle magazine and a stuffing tool which moves in a plane between a bundle take-over position and a stuffing position, said stuffing tool being pivotally mounted about a pivot axis for tracing a circular arc within said plane, said pivot axis being perpendicular to the plane of stuffing tool movement between the take-over position and the stuffing position.

8. The brush stuffing machine as claimed in claim 7, further including a tongue associated to the stuffing tool, said tongue being movable on a circular arc whose center lies on the same axis as the pivot axis of the stuffing tool.

9. The brush stuffing machine as claimed in claim 8, wherein the movements of the stuffing tool and the tongue are synchronized with each other when the same are swivelled from the bundle take-over position into the stuffing position.

10. The brush stuffing machine as claimed in claim 7, further including a bundle pick-up for cooperating with a bristle magazine in order to transfer a bundle of bristles to the stuffing tool in the bundle take-over position, the bundle pick-up being pivotally mounted about an axis which is parallel to the axis of the stuffing tool.

11. The brush stuffing machine as claimed in claim 7, further including a wire cutter for cooperating with the stuffing tool in order to transfer a wire anchor to the stuffing tool.

* * * * *